US008056706B2

(12) United States Patent
Koyuncu

(10) Patent No.: US 8,056,706 B2
(45) Date of Patent: Nov. 15, 2011

(54) WATER CARRYING LIFT

(75) Inventor: Mehmet Koyuncu, Istanbul (TR)

(73) Assignee: Zafer Koyuncu, Istanbul (TR)

( * ) Notice: Subject to any disclaimer, the term of this patent is extended or adjusted under 35 U.S.C. 154(b) by 0 days.

(21) Appl. No.: 13/015,943

(22) Filed: Jan. 28, 2011

(65) Prior Publication Data

US 2011/0123278 A1 May 26, 2011

Related U.S. Application Data

(63) Continuation of application No. PCT/TR2008/000089, filed on Jul. 30, 2008.

(51) Int. Cl.
*B65G 17/36* (2006.01)

(52) U.S. Cl. ..... 198/702; 198/704; 198/710; 198/711; 198/530; 198/549

(58) Field of Classification Search ..... 198/702, 198/704, 710, 711, 530, 549; 405/82; 166/69
See application file for complete search history.

(56) References Cited

U.S. PATENT DOCUMENTS

| | | | | |
|---|---|---|---|---|
| 1,157,639 | A * | 10/1915 | Prince | 405/82 |
| 1,829,625 | A | 10/1931 | Adams et al. | |
| 2,694,366 | A * | 11/1954 | Miller | 198/702 |
| 4,552,220 | A * | 11/1985 | Jones | 166/369 |

FOREIGN PATENT DOCUMENTS

| | | |
|---|---|---|
| FR | 459108 | 10/1913 |
| FR | 585736 | 3/1925 |
| FR | 2625534 | 7/1989 |

* cited by examiner

*Primary Examiner* — Joseph A Dillon, Jr.
(74) *Attorney, Agent, or Firm* — Michael J. Feigin, Esq.; Feigin & Associates, LLC

(57) ABSTRACT

This invention is about water carrying lift that enables water to be used in watering fields (agricultural fields), energy production, etc by increasing the level of water in places like rivers, streams, creeks etc.

10 Claims, 5 Drawing Sheets

WATER CARRYING LIFT

BACKGROUND OF THE DISCLOSED TECHNOLOGY

This invention is about water carrying lift that enables water to be used in watering fields (agricultural fields), energy production, etc by increasing the level of water in places like rivers, streams, creeks etc.

At present, users absorb water from rivers, creeks, streams by the help of pumps operating by energy resources like electricity, fuel, etc. and pump it to the area desired to be watered. These pumps which are used to water fields bring financial cost to users because they cause energy consumption and cause harm to the economy of the country due to unnecessarily wasted energy resources. Also, when it is considered that electricity energy can not be taken to everywhere and used, users who want to make watering in these areas have great difficulty.

SUMMARY OF THE DISCLOSED TECHNOLOGY

Thanks to the product subject to the invention level of water in places like river, creek, stream etc. is increased to the desired level without need to any energy resource. The water level of which is increased is transferred easily to the places in lower levels and these areas are watered. Again with the product subject to the invention potential energy of the water increases because level of water is increased. In case it is desired this water which has gained a potential energy is directed to a lower level point and potential energy is converted to kinetic energy and with this kinetic energy a tribune is revolved like in hydroelectric power plants and electricity energy is gained. Thanks to the product subject to the invention watering agricultural fields without need to any energy resource cost of products grown get lower and their competition power in the market is increased. Again thanks to the product subject to the invention removing need for energy to water areas and gaining electricity energy with simple systems that will be attached will contribute to the economy of the country. The product subject to the invention working mechanically without need for any energy resource provide it to unction without any interruption and lower its maintenance and repair costs to a very little amount like nothing.

BRIEF DESCRIPTION OF THE DRAWINGS

The product subject to the invention is displayed with attached figures.

PARTS LIST

Figure 1:
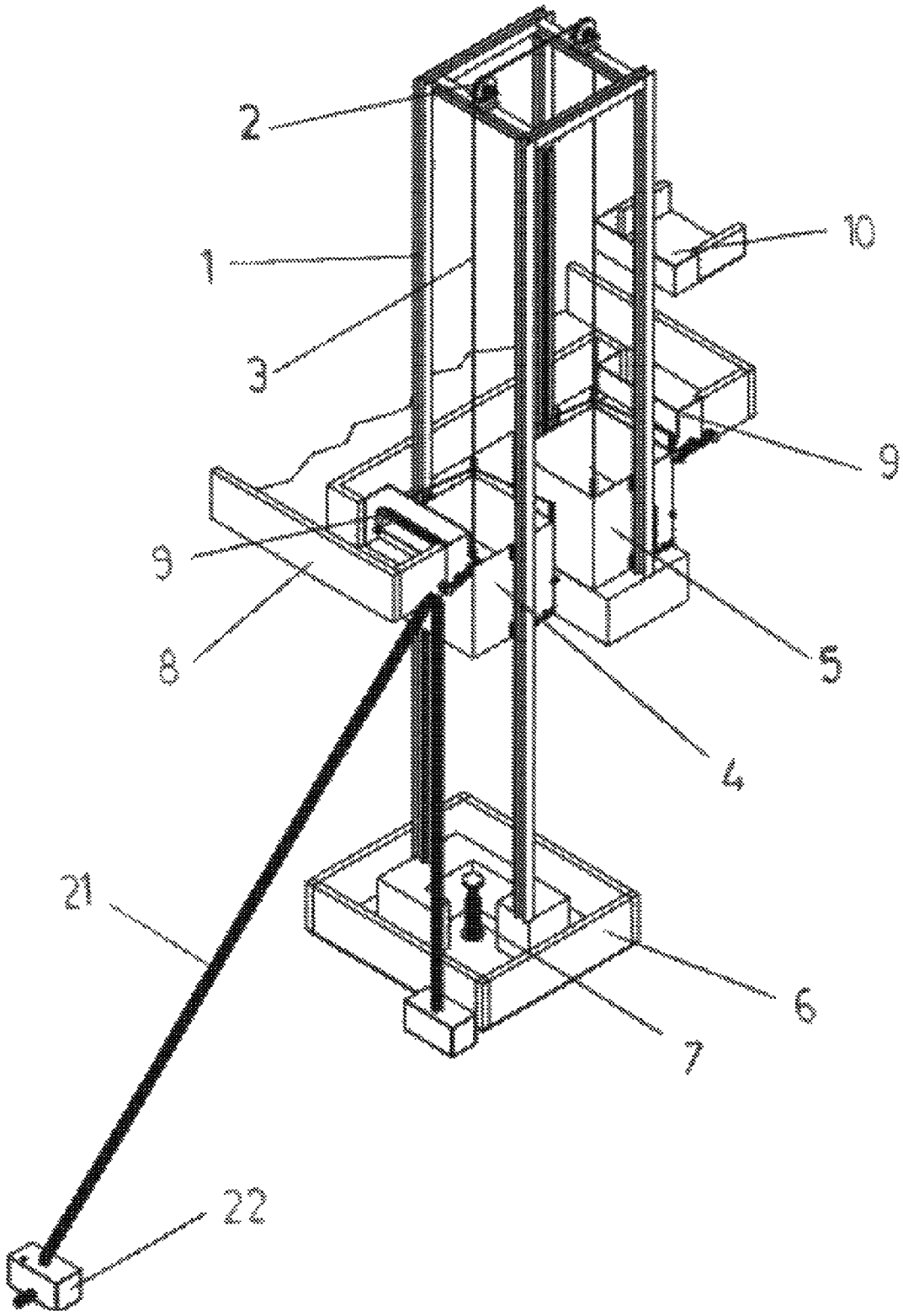
FIG. 1 Perspective appearance of the product subject to the invention.
Figure 2:
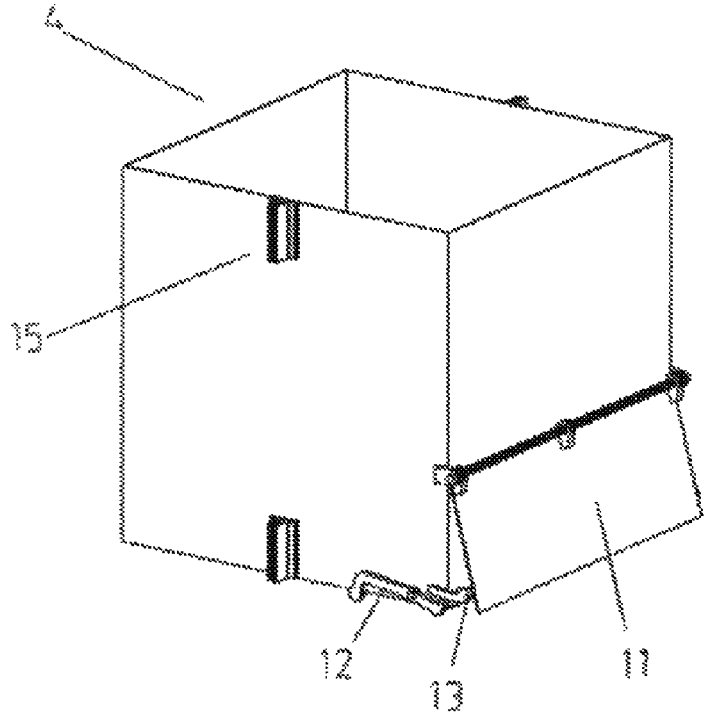
FIG. 2 Appearance of great volume water carrying tank.
Figure 3:
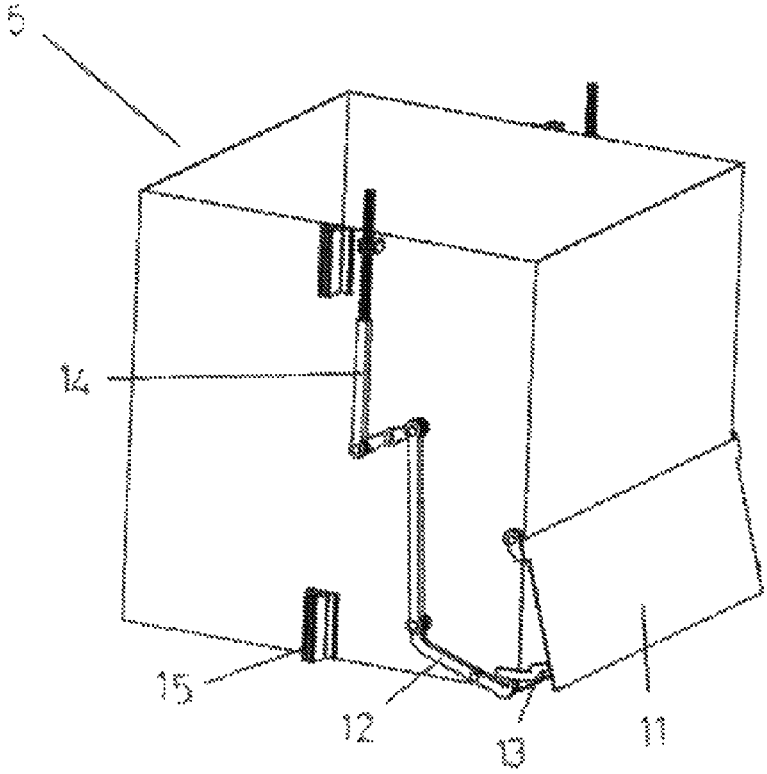
FIG. 3 Appearance of small volume water carrying tank.
Figure 4:
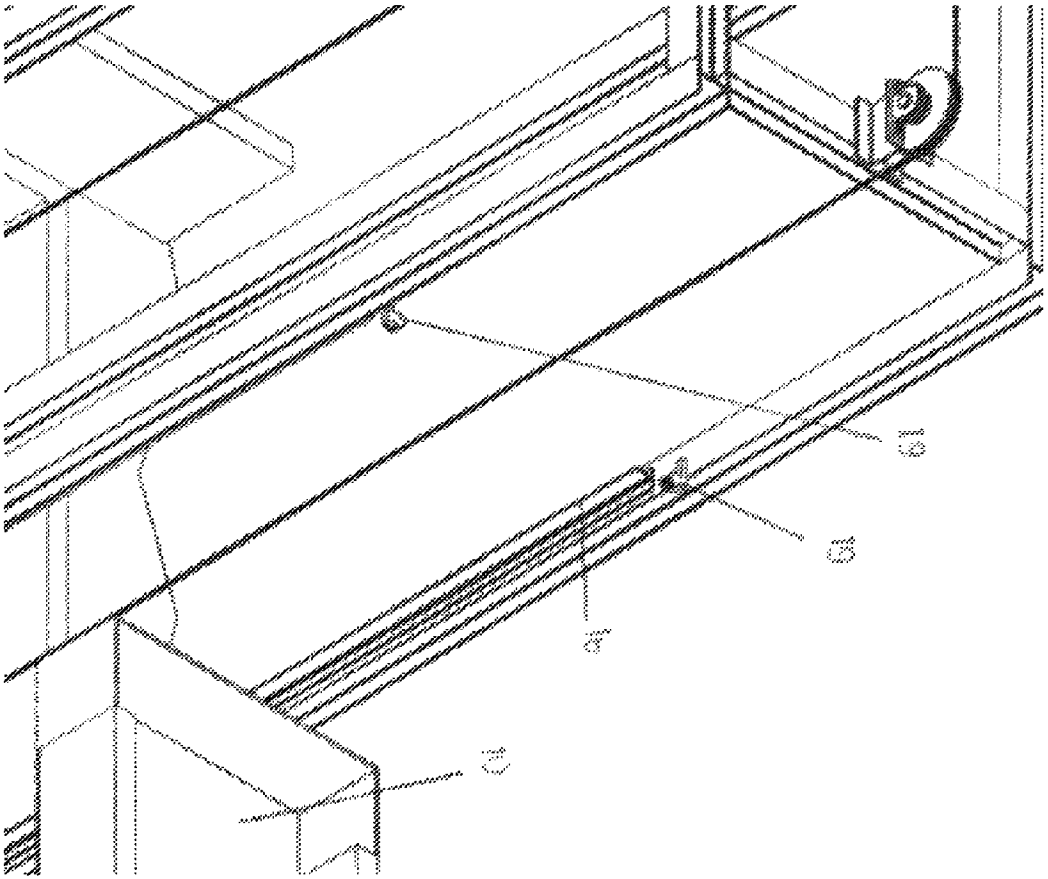
FIG. 4 Appearance of rails and discharge parts on steel construction.
Figure 5:
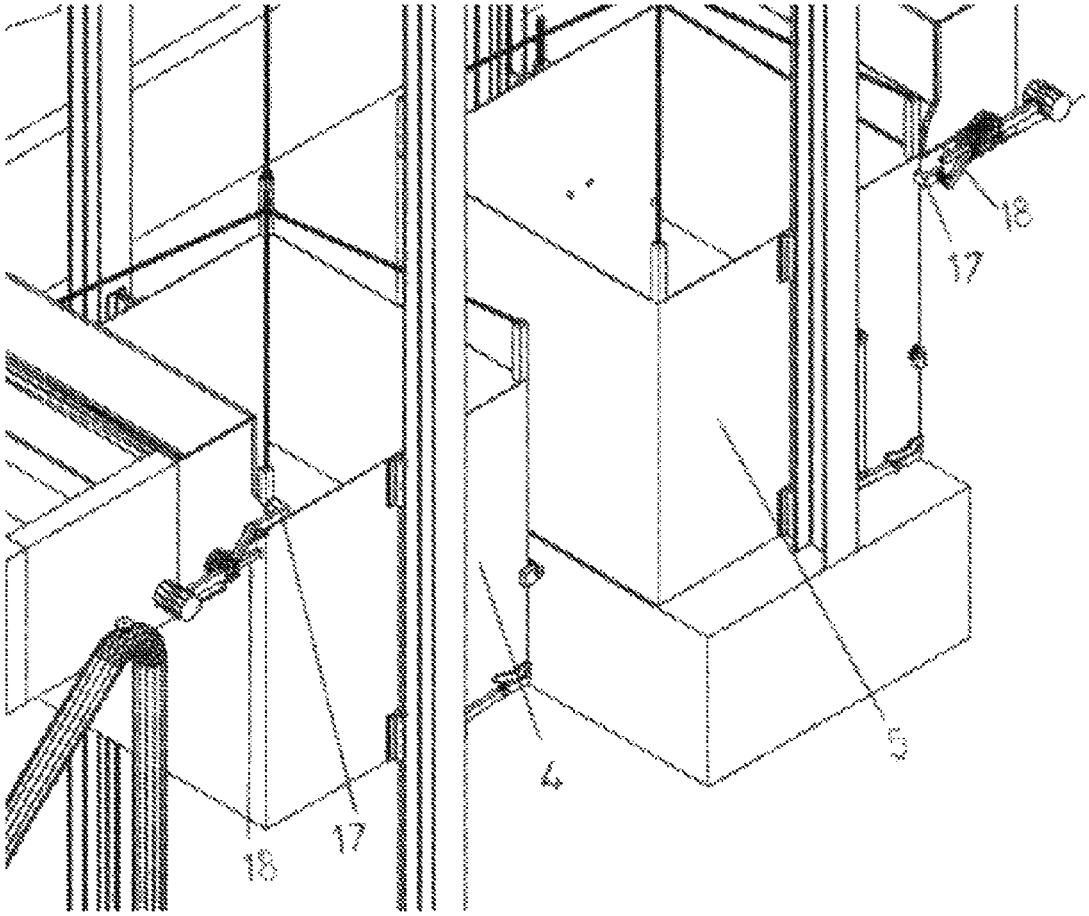
FIG. 5 Appearance of opening-closing parts and fork latches on the product subject to the invention.
Figure 6:
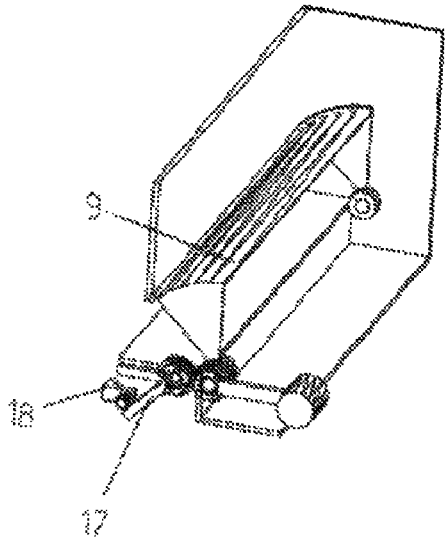
FIG. 6 Appearance of filling lid.
Figure 7:
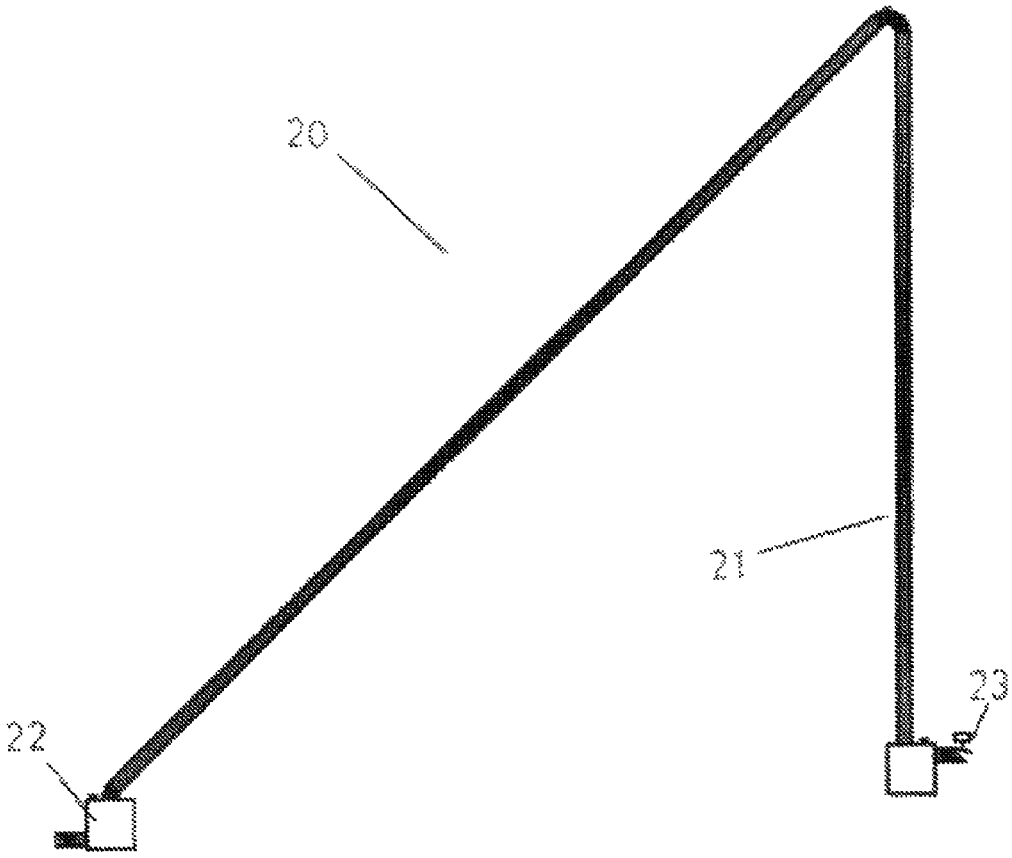
FIG. 7 Appearance of vacuuming system.

Meanings of part numbers on these parts,
Steel construction
Roller
Steel rope
Great volume water carrying tank
Small volume water carrying tank
Lower reservoir Braking system
Filling section
Filling lids
Water output reservoir
Discharge lids
Locking key
Locking flange
Locking key motion rod
Rail skate
Rail
Opening-closing parts
Fork latch
Discharge part
Vacuuming system
Discharge pipe
Discharge reservoir
Lid connected to buoy

DETAILED DESCRIPTION OF EMBODIMENTS OF THE DISCLOSED TECHNOLOGY

There is a steel construction (1) that constitute the frame in the product subject to the invention. There are rollers (2) placed opposing on the upper side of the steel construction (1). Steel rope (3) is placed on these rollers (2). There is great volume water carrying tank (4) on one end of the steel rope and small volume water carrying tank (5) on the end of it. Thickness of great volume water carrying tank(4) is thinner than the thickness of small volume water carrying tank (5). For this reason weight of great volume water carrying tank (4) is lower compared to small volume water carrying tank (5) in the product subject to the invention. There is a lower reservoir (6) on the product subject to the invention. This lower reservoir (6) is placed on the lower part of the ground in the level the water is desired to be increased. A braking system (7) is placed to the place where great volume water carrying tank will be placed on the lower reservoir (6). There is another braking system (7) just below the small volume water carrying tank (5) on the product subject to the invention. There are filling lids (9) and filling section(8) on the middle section of the steel construction (1) in other words normal ground level of river, creek, stream on the product subject to the invention. Again on the product subject to the invention there is a water output reservoir (10) on the side of small volume water carrying tank (5) on the upper section. There are discharge lids (11) on the below sides of water carrying tanks (4 and 5). Discharge lids (11) are closed normally thanks to locking key (12), locking flange (13) and locking key motion rod (14). Also rail skates (15) are placed on sides of water carrying tanks (4 and 5). These rail skates (15) provide proper vertical upwards and downwards motion of water tanks (4 and 5) together with rails (16) placed on steel construction (1).

In the usage of the product subject to the invention while the small volume water carrying tank (5) move vertically downwards by the help of rail skates (15) and rails (16) great volume water carrying tank (4) it is connected with steel rope (3) moves vertically upwards. When small volume water carrying tank (5) reaches ground level (normal level where river, creek, etc. is found) opening and closing parts (17) placed on sides of both carrying tanks (4 and 5) give motion to fork tongue (18) placed on filling lids (9) and makes filling lids open and water fill in carrying tanks (4 and 5) from water filling section. While small volume water carrying tank (5) comes down braking system (7) comes over it so that it prevented from any harm. Water that drains in equal amounts to the tanks from water filling section (8) fills small volume water filling tank (5) first. After small volume water filling tank (5) is filled filling of great volume water filling tank (4) continue thanks to its greater volume. This more water filling in great volume water filling tank (4) makes total weight of great volume water filling tank (4) (total of the water inside and itself) heavier than total weight of small volume water carrying tank (5) (total of the water inside and itself) and while great volume water carrying tank (4) move vertically downwards it moves small volume water carrying tank (5) upwards. Meanwhile opening-closing parts (17) placed on tanks (4 and 5) move fork latches placed on filling lids (9) in the opposite direction and closes filling lids (9) and stops water. When the discharge lid (11) on the small volume water carrying tank (5) comes to the level of water output reservoir (10) locking key motion rod (14) placed on the small volume water carrying tank (5) gets in touch with discharge part (19) on the construction (1) and moves locking key (12) and makes locking key (12) free from locking flange (13) and opens discharge lid (11) and makes water fill in water output reservoir (10). Simultaneously discharge part (19) on the construction contacts locking key (12) placed on great volume water carrying tank (4) and moves it and makes locking key (12) free from locking flange (13) and the water discharges lower reservoir (6). Small volume water discharge tank (5) discharges first and waits for great volume water discharge tank (4) because the water discharges from the equal size lids (till getting over the weight of great volume water discharge tank). Tanks that are discharged (4 and 5), complete their cycle and carry water to the level of water output reservoir (10) and the same cycle starts again. Water, level of which is increased, is directed to lower level areas and these areas are watered. Again if desired water which has gained potential energy because level of it is increased is directed to a lower level point and the potential energy is converted to kinetic energy and with this kinetic energy provided electricity energy can be gained by revolving a tribune like in hydroelectric power plants.

Water that is discharged in the lower reservoir (6) in the product subject to the invention can be directed to river bed directly by opening a canal in the districts with enough slope on the other hand in places where slope is not enough and canal opening process will be difficult it can be discharged in river bed by vacuuming system (20). There are discharge pipes (21)which are filled with water the air inside is taken and a discharge reservoir placed at the end of these pipes in vacuuming system (20). In this system water in the lower reservoir (6) is taken upwards with the help of discharge pipes filled with water free from air and then it is discharged into the discharge reservoir (22) from here it is discharged to the river bed. In this system discharge speed of water in lower reservoir (6) is higher than filling speed of lower reservoir (6) (than the water discharged from great volume water carrying tank). By this way water accumulation in lower reservoir (6) is prevented. A lid (23) connected to the buoy is placed on the entrance point discharge pipe (21) of water in lower reservoir (6). By this way air contact of vacuum system is prevented by closing mouth of discharge pipe (21) line when water in lower reservoir(6) goes down under a definite level. When the water in the well starts filling the lid connected to the buoy (23) opens again lets water intake.

The invention claimed is:

1. A water carrying lift for lifting and lowering water, comprising:

a steel construction that constitutes a frame, opposing rollers on an upper side of the steel construction, a steel rope placed on said rollers, a first water carrying tank at the one end of the steel rope, a second smaller volume water carrying tank than the first water carrying tank connected to the other end of the steel rope, a lower reservoir beneath the surface of the ground equal to the level of water desired to be elevated, a braking system just below the small volume water carrying tank and where the first volume water carrying tank is placed, a filling section at ground level of a creek, river, or stream, filling lids placed in the filling section, a fork latch opening and closing the filling lid, a water output reservoir placed on a side of the smaller volume water carrying tank on an upper side thereof, a vacuuming system and rails placed on the steel construction said lift configured and operable to lower water to said lower reservoir while lifting water to said output reservoir.

2. The water carrying lift of claim 1, wherein the first water carrying tank comprises a thickness thinner than the second water carrying tank and having a greater volume than the second water carrying tank.

3. The water carrying lift of claim 2, wherein rail skates are placed on the first water carrying tank, along with a discharge lid placed on a lower side of thereof, a locking key placed on the discharge lid, locking latch placed over a locking flange and opening-closing parts which are movable only in an opposite direction to fork latches placed on the filling lids.

4. The water carrying lift of claim 1, wherein the first water carrying tank has a lighter empty weight than the second water carrying tank.

5. The water carrying lift of claim 4, wherein the first water carrying tank has a total weight greater than that of the small volume water carrying tank when filled with water.

6. The water carrying lift of claim 1, wherein the second water carrying tank comprises a thickness thicker than the first water carrying tank and has a smaller volume than the first water carrying tank.

7. The water carrying lift of claim 6, wherein the first water carrying tank comprises rail skates placed there on, a discharge lid placed on a lower side, a locking flange placed on the discharge lid, a locking key coming over the locking flange, a locking key motion rod which gives motion to the locking key by way of movement from a discharge part placed on steel construction and opening-closing parts that give opposite motion to latches placed on the filling lids.

8. The water carrying lift of claim 6, wherein the second water carrying tank is heavier than the first water carrying tank when empty.

9. The water carrying lift of claim 8, wherein the second water carrying tank comprises a lighter total weight than the first water carrying tank, when filled with water.

10. The water carrying lift of claim 1, further comprising a vacuuming system characterized as having airless discharge pipes filled with water and a discharge reservoir at the end of these pipes, a lid connected to a buoy placed on a point where water enters a discharge pipe of the airless discharge pipes.

* * * * *